US005195872A

United States Patent [19]

Morgan

[11] Patent Number: 5,195,872

[45] **Date of Patent: * Mar. 23, 1993**

[54] PADDLEWHEEL APPARATUS

[76] Inventor: Bruce S. Morgan, Embassy Park 3188 Lake Shore Dr., Pembroke Park, Fla. 33009

[ * ] Notice: The portion of the term of this patent subsequent to Jan. 21, 2009 has been disclaimed.

[21] Appl. No.: 737,336

[22] Filed: Jul. 29, 1991

Related U.S. Application Data

[63] Continuation-in-part of Ser. No. 549,952, Jul. 9, 1990, Pat. No. 5,082,423.

[51] Int. Cl.[5] ..... B63H 1/10

[52] U.S. Cl. ..... 416/111; 416/131; 415/141; 475/331

[58] Field of Search ..... 416/98, 111, 131, 140; 440/90, 91, 92, 94; 475/305, 331, 346; 415/122.1, 124.1, 140, 141

[56] References Cited

U.S. PATENT DOCUMENTS

| | | | |
|---|---|---|---|
| 583,171 | 5/1897 | Curry . | |
| 1,540,257 | 6/1925 | Doehlert, Jr. . | |
| 1,636,423 | 7/1927 | Langenbach | 416/111 |
| 1,708,475 | 4/1929 | Krodel | 416/111 |
| 1,811,031 | 6/1931 | Smith et al. | 416/111 |
| 2,036,727 | 4/1936 | Stow . | |
| 2,258,699 | 10/1941 | Calvo-Mackenna | 415/141 |
| 3,027,863 | 4/1962 | Town . | |
| 3,131,772 | 5/1964 | Town . | |
| 3,915,586 | 10/1975 | Gassie . | |

*Primary Examiner*—John T. Kwon
*Assistant Examiner*—James A. Larson
*Attorney, Agent, or Firm*—Oltman and Flynn

[57] ABSTRACT

This invention is a paddlewheel apparatus having epicyclic gear trains in rotatable holders at opposite ends of a plurality of paddles. The paddles are maintained substantially vertical throughout the rotation of the holders and they are completely unobstructed by any other part of the apparatus in all phases of operation. A housing which extends over the holders and the paddles is open at the bottom to pass the downwardly hanging paddles into the water.

4 Claims, 11 Drawing Sheets

FIG. 10
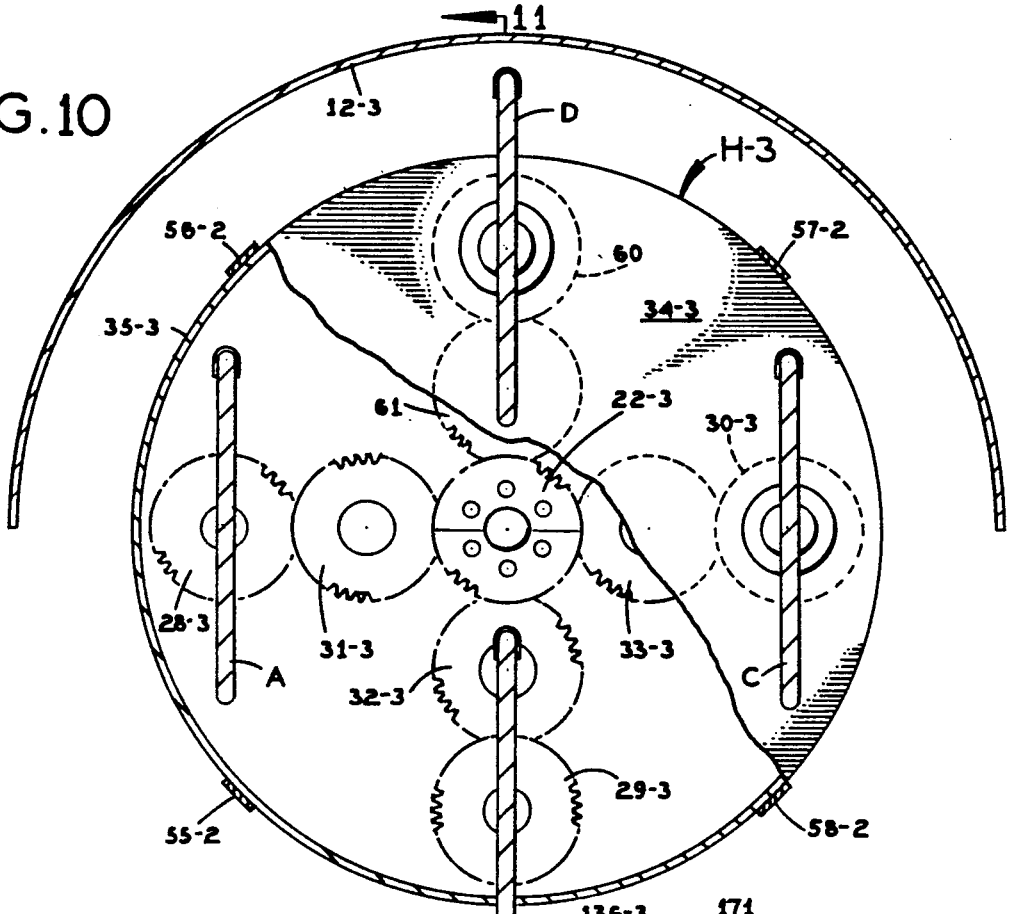
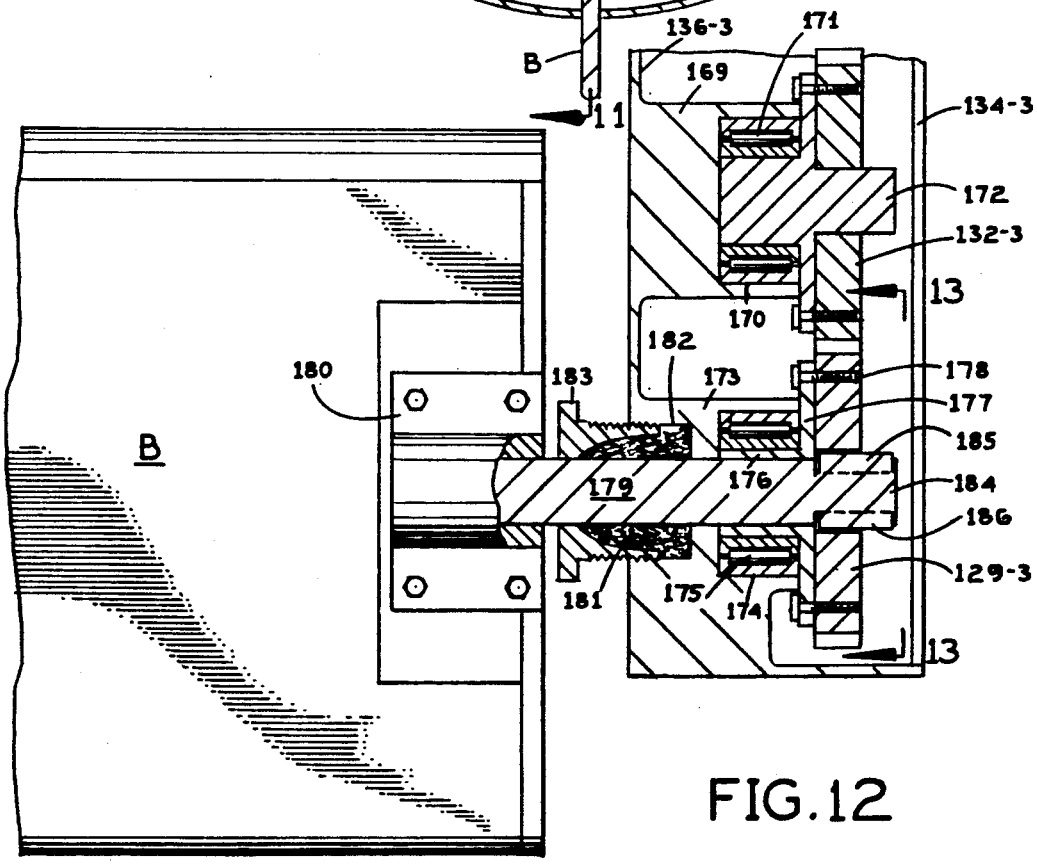
FIG. 12

PADDLEWHEEL APPARATUS

CROSS-REFERENCE TO RELATED APPLICATION

This application is a continuation-in-part of application Ser. No. 07/549,952, filed on Jul. 9, 1990, U.S. Pat. No. 5,082,423.

SUMMARY OF THE INVENTION

The present invention relates to a paddlewheel apparatus of the type in which the paddles are maintained substantially at a predetermined angle, preferably vertical, throughout the rotation of the paddlewheel.

A primary objective of the invention as described herein is its use as a highly effective propulsion device for ships, boats and various other types of watercraft which are generally moved about by screw type propellers or waterwheels. The attainment of increased efficiency is made possible primarily by the force, or pressure surfaces, of the device (as in the paddles employed) being maintained during movement substantially perpendicular to the water through which they move. Therefore, the most advantageous paddle angle is achieved to obtain the optimum thrust created by the continual longitudinal rearward or forward direction of force or pressure upon the water, relative to the movement of the watercraft. As water movement is substantially horizontal and is not directed and pressured into a power wasting contrary angle relative to that of the watercraft movement, such as in the action of screw propellers, a more efficient use of the power source employed in the movement of watercraft is attainable.

A further object of the device is use as an efficient power furnishing component in the generation of electricity and the operation of other types of devices. The substantially maintained vertical mode of the paddles employed presents the maximum surface area and most effective paddle to water angle for receiving maximum horizontal pressure upon them by water in motion such as that of rivers, canals, ocean currents or ocean tide waters which have been directed into land areas to form channels or canals.

Another object of this invention is to provide such a paddlewheel apparatus in which the paddles are completely unobstructed below by any other part of the apparatus, thereby enabling the use of paddles which are longer vertically and can dip farther into the water.

Further objects and advantages of this invention will be apparent from the following detailed description of four presently preferred embodiments which are illustrated schematically in the accompanying drawings.

Preferably, the paddlewheel apparatus according to this invention has fixed, coaxial, non-rotatable sun gears at its opposite ends, each part of respective epicyclic gear train/trains having idler gears engaged between the sun gear and respective planet gears. Each epicyclic gear train is in a corresponding holder which is rotatable on the axis of the sun gears and rotatably supports the idler and planet gears of that gear train. Paddles are coupled at opposite ends to respective planet gears of each epicyclic gear train. Between the rotatable holders the paddles are completely unobstructed below by any other part of the paddlewheel apparatus. The gear trains maintain the paddles substantially vertical throughout each rotation of the holders.

The paddles are preferably free to pivot in the direction of fluid flow to prevent drag. Each paddle is mounted at either end on axle means, which may take the form of a centering pin, extending into a planet gear. The centering pin is preferably free to pivot within the planet gear. A bushing separates the planet gear and centering pin, and has a broken section which creates a radial gap between the planet gear and centering pin. The centering pin preferably has a diametrically oriented keyway and a key which extends from the keyway into the gap. The key and gap permit the paddle to pivot freely in one direction but hold the paddle against pivoting in the other direction. This permits the paddle to drive against the fluid in one direction and pivot to prevent drag in the other. A lever may be provided on at least one of the sun gears to reorient the planet gear gaps for reverse operation. For this embodiment the sun gears are freed to rotate with the lever.

Figure 2:
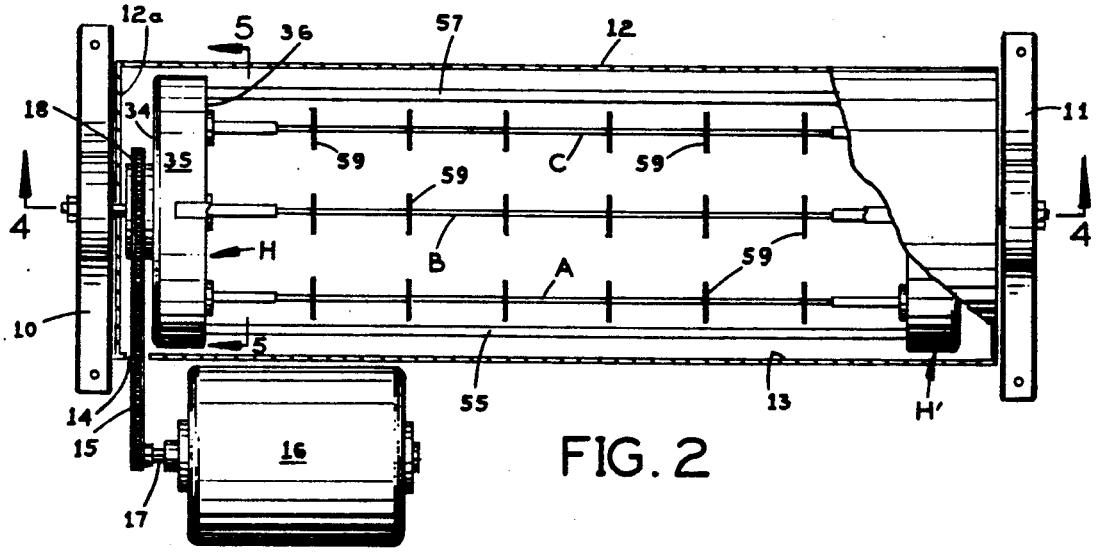
FIG. 2 is a top plan view of this apparatus with most of its housing broken away.

FIG. **10*a* is a vertical cross-section taken along line 10*a*—10*a* in FIG. 2**.

Figure 10A:
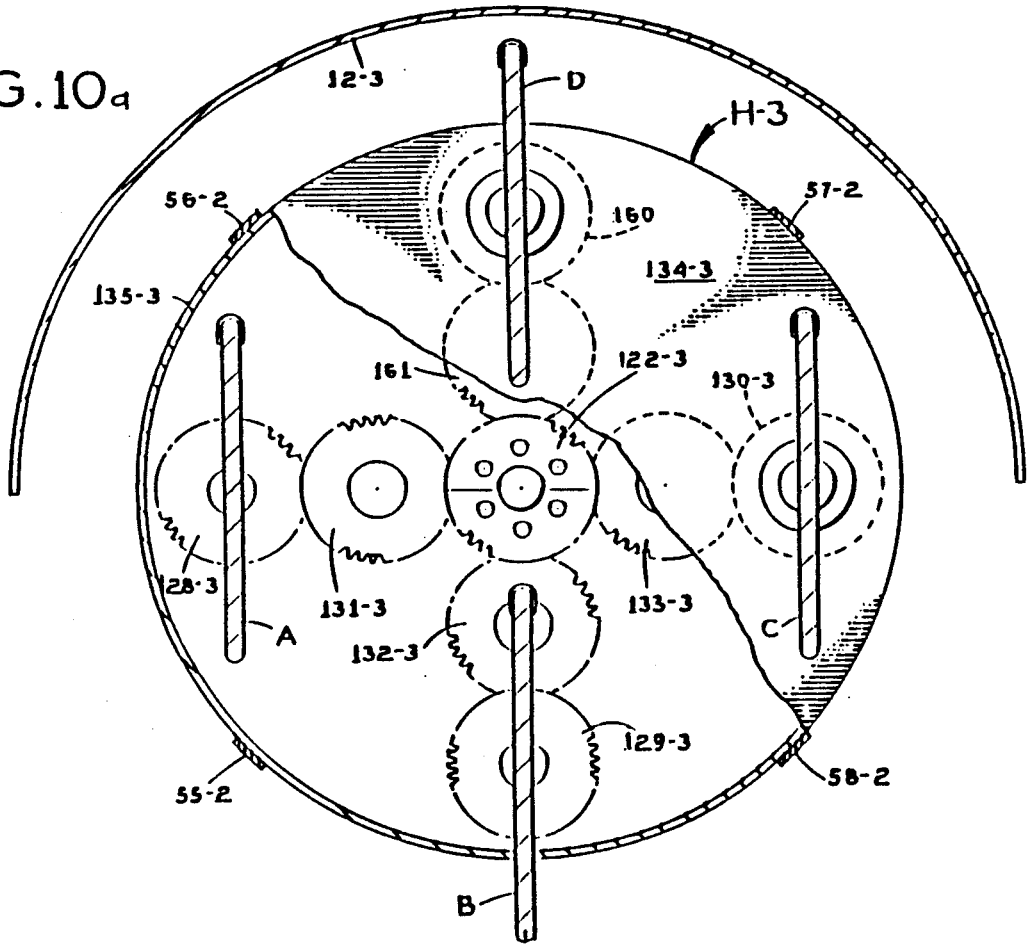
FIG. 10 is a view like FIG. 5 but showing a third embodiment of the present paddlewheel apparatus.
Figure 11:
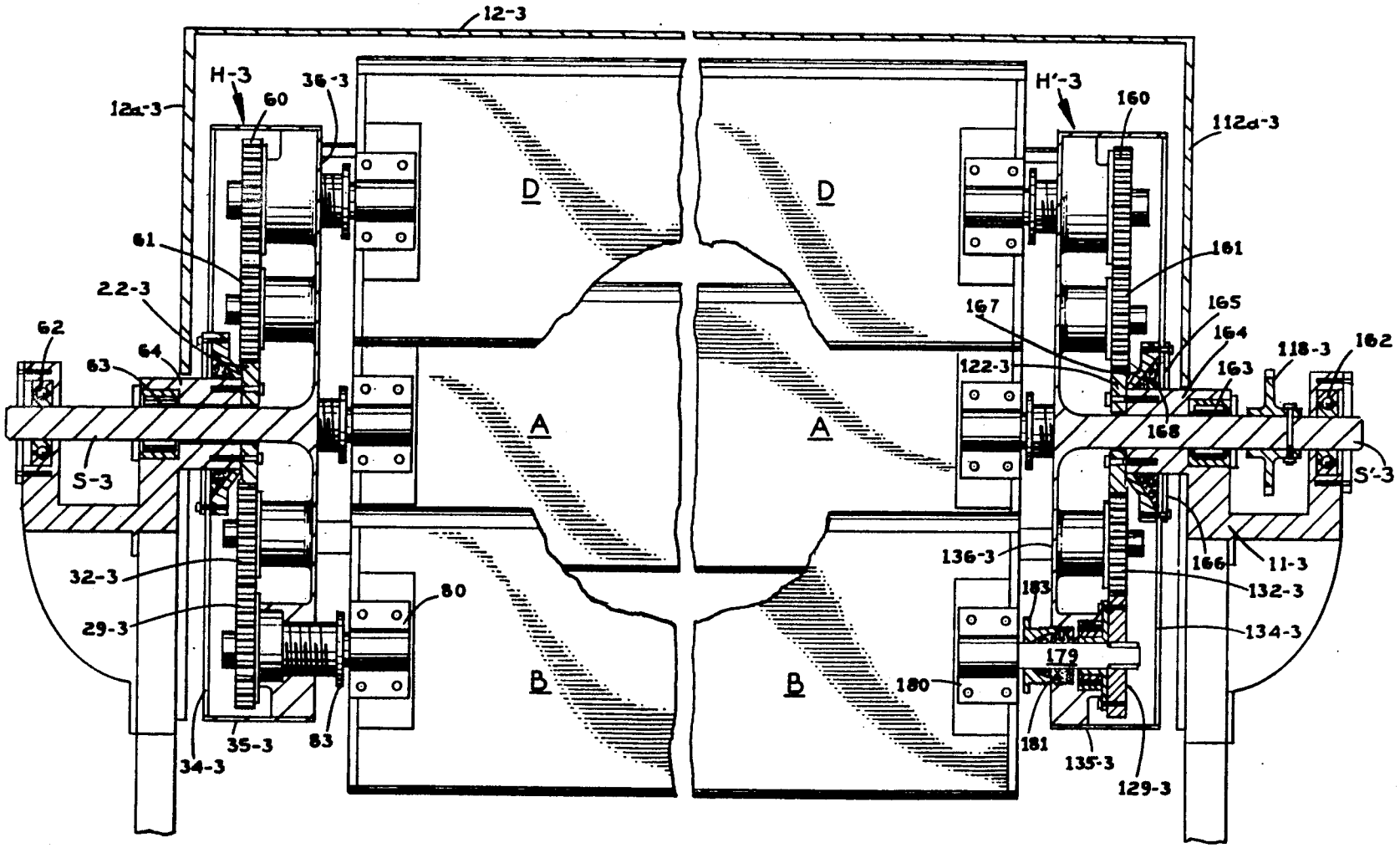
Figure 13:
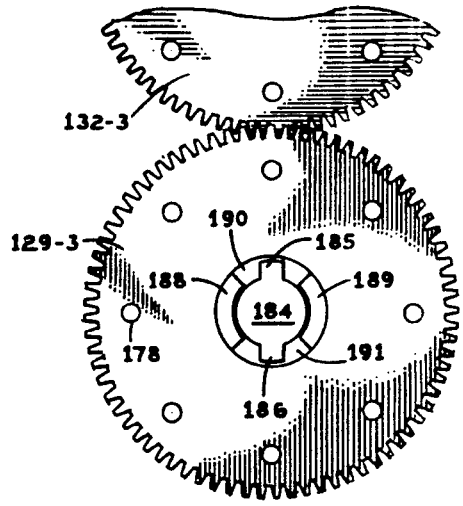
Figure 14:
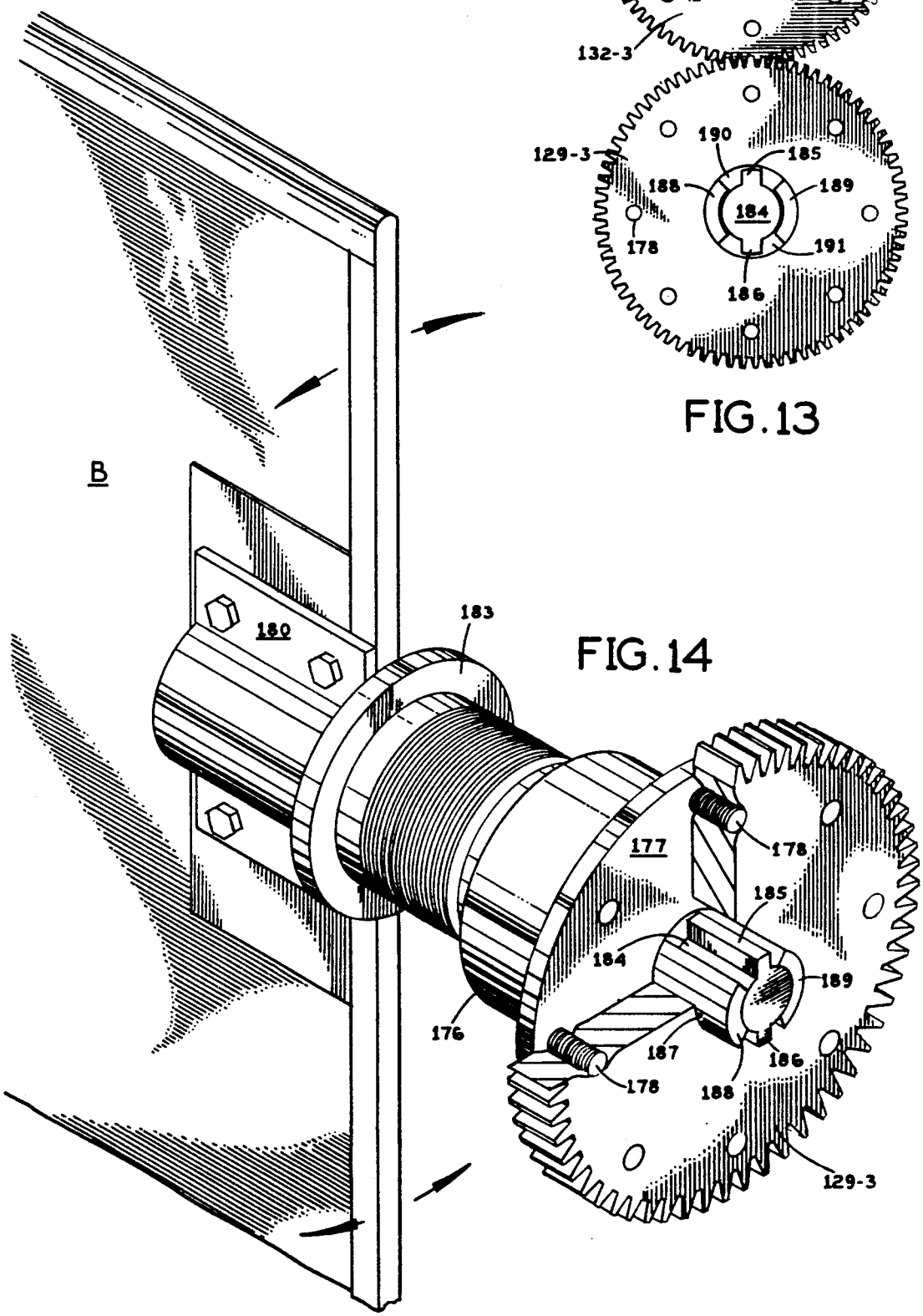

FIG. 11 is a longitudinal vertical sectional view of this third embodiment taken along the line 11—11 in FIG. 10;

FIG. 12 is an enlarged fragmentary vertical section showing the lost-motion coupling between one paddle and the corresponding planet gear in the epicyclic gear train at one end;

FIG. 13 is a fragmentary end elevation taken from the line 13—13 in FIG. 12; and FIG. 14 is perspective view, with parts broken away and other parts removed, showing the same lost-motion coupling as FIG. 12.

Figure 15:
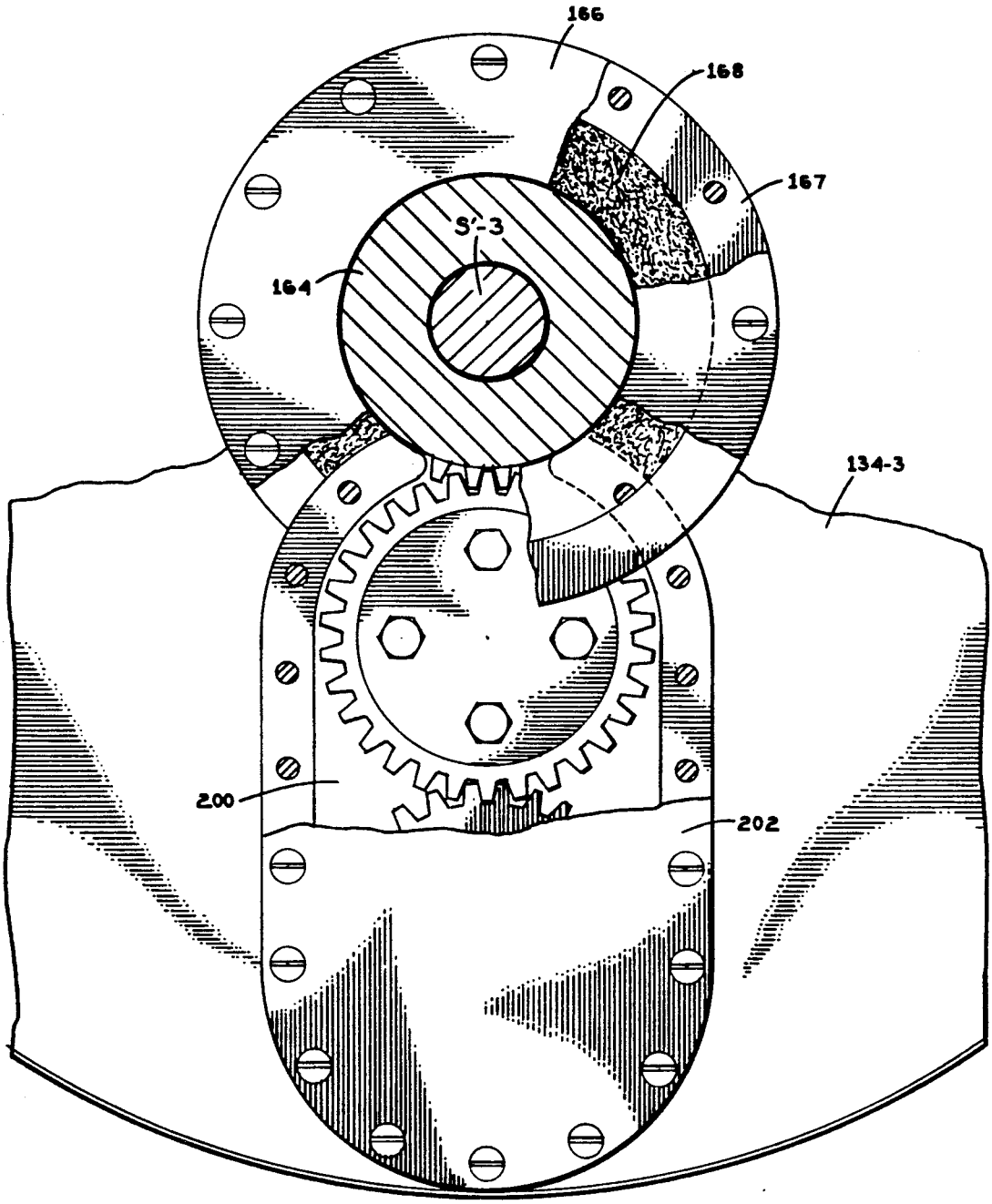

FIG. 15 shows covers on a holder.

Figures 16, 18:
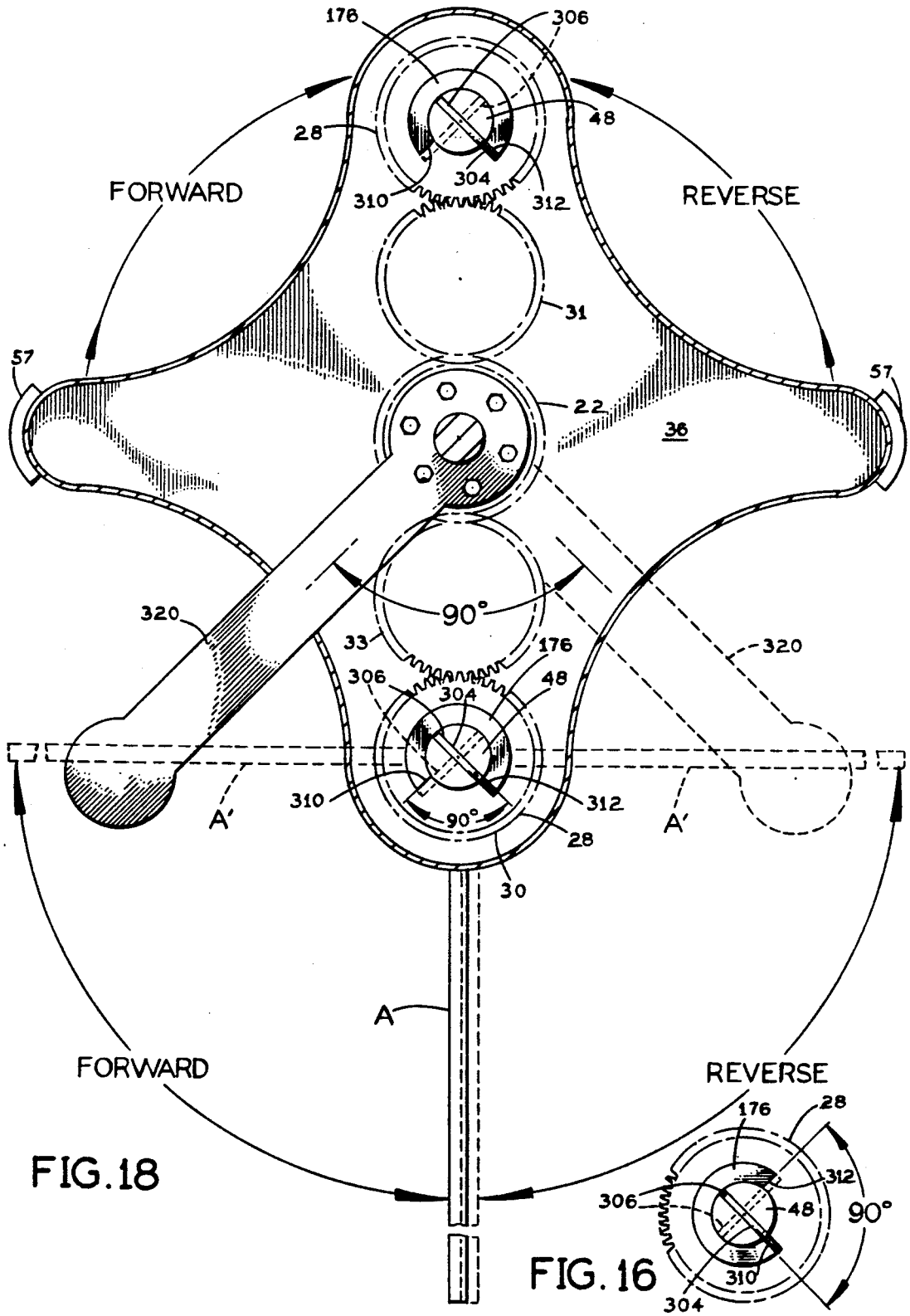

FIG. 16 is an end view of a planet gear, bushing and centering pin only, showing the key at one end of the bushing gap and the key in broken lines at the other end of the gap, defining a range of free centering pin and paddle rotation of ninety degrees.

Figure 17:
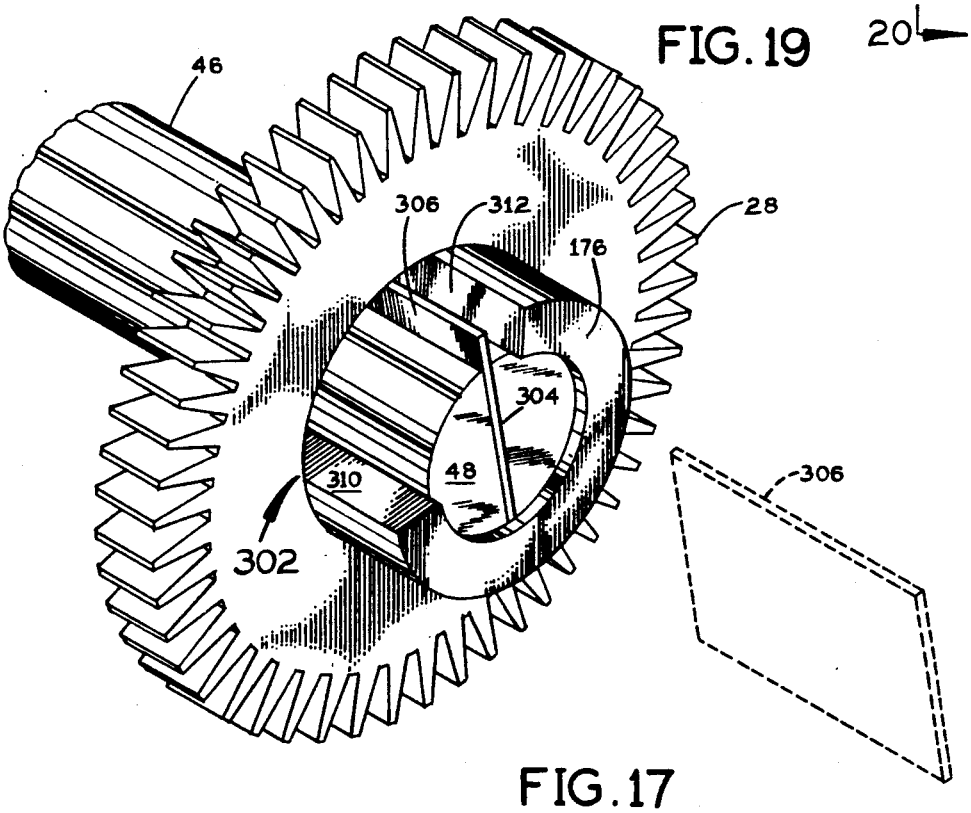

FIG. 17 is a perspective close-up view of a planetary gear and the centering pin of a paddle illustrating the key and keyway and the bushing gap, with a key shown separately in broken lines.

FIG. 18 is an end view of an epicyclic gear holder and one paddle, revealing one row of gears, and showing the lever in one extreme position and the lever again in broken lines in the other extreme position, and illustrating with arrows the forward and reverse movements of the holder and the corresponding fixed and pivot positions of a given paddle.

Figure 19:
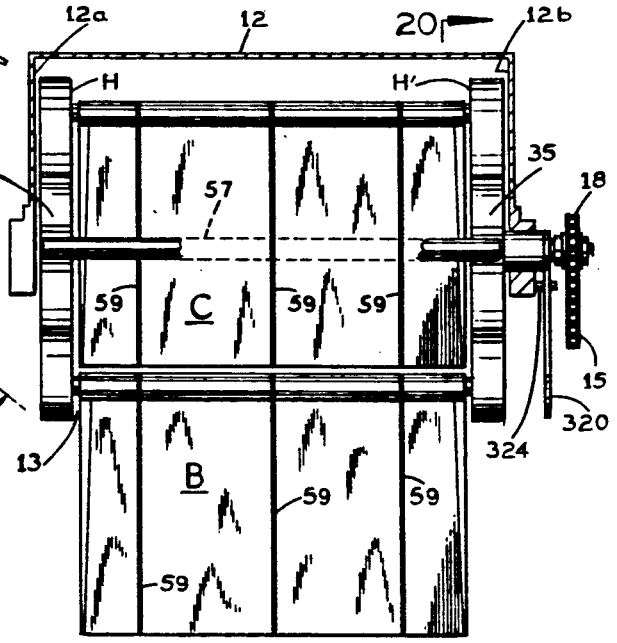

FIG. 19 is a front view of the paddlewheel apparatus in accordance with the fourth embodiment of the present invention, showing a sun gear lever on the right end.

Figure 20:
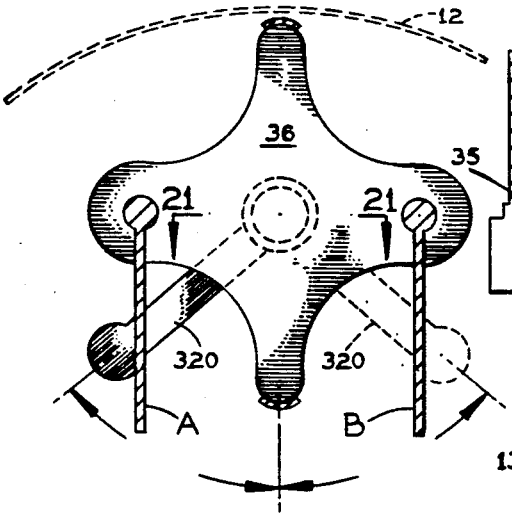

FIG. 20 is a lateral sectional view of this fourth embodiment, taken along line 20—20 of FIG. 19, showing the lever means attached to the sun gear in one extreme position and again in broken lines in the other extreme position.

Figure 21:
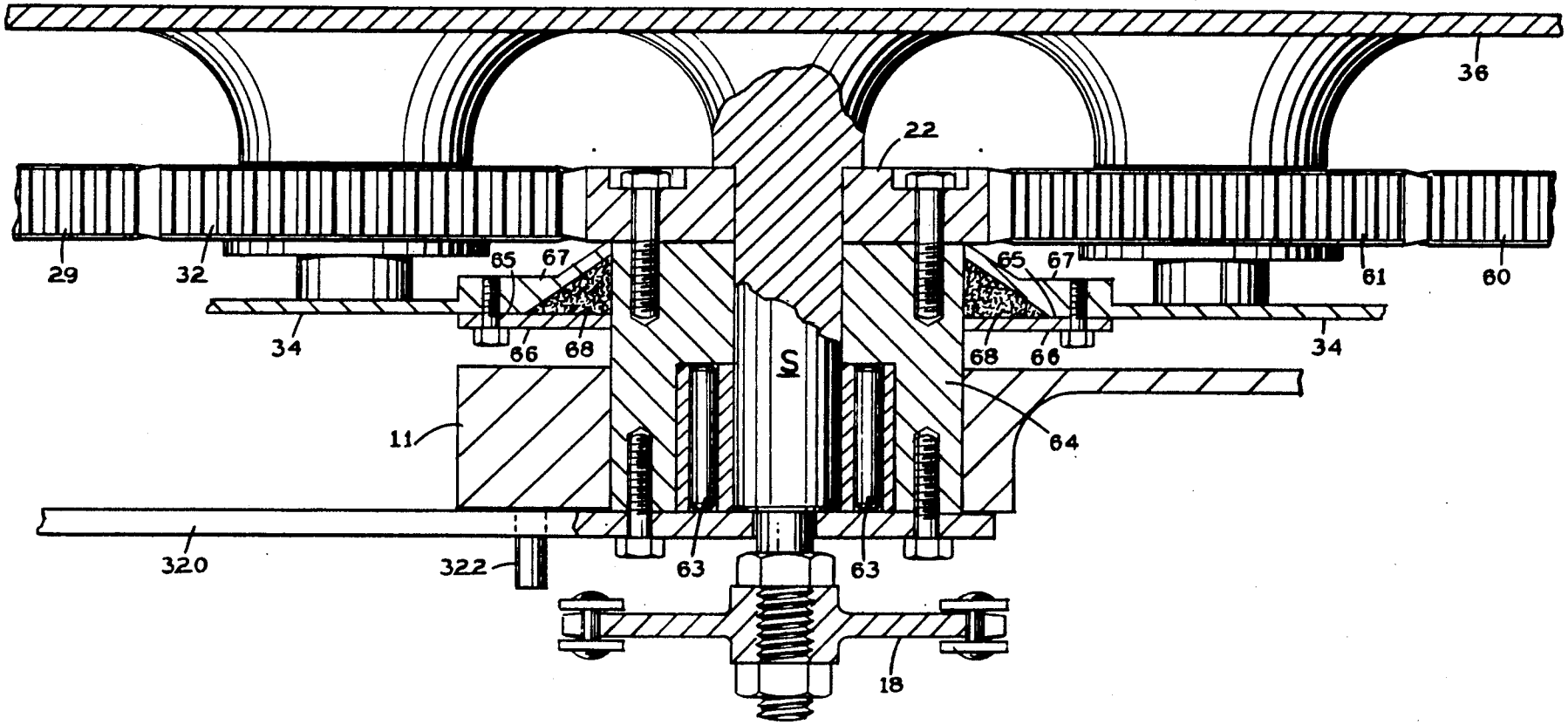

FIG. 21 is an edge view of an epicyclic gear train.

Figure 22:
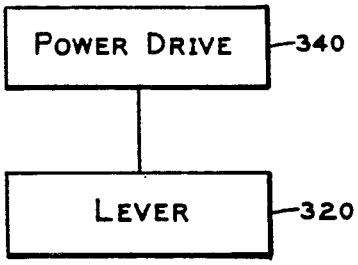

FIG. 22 is a schematic view of a power drive connected to a lever.

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

First Preferred Embodiment

Figure 1:
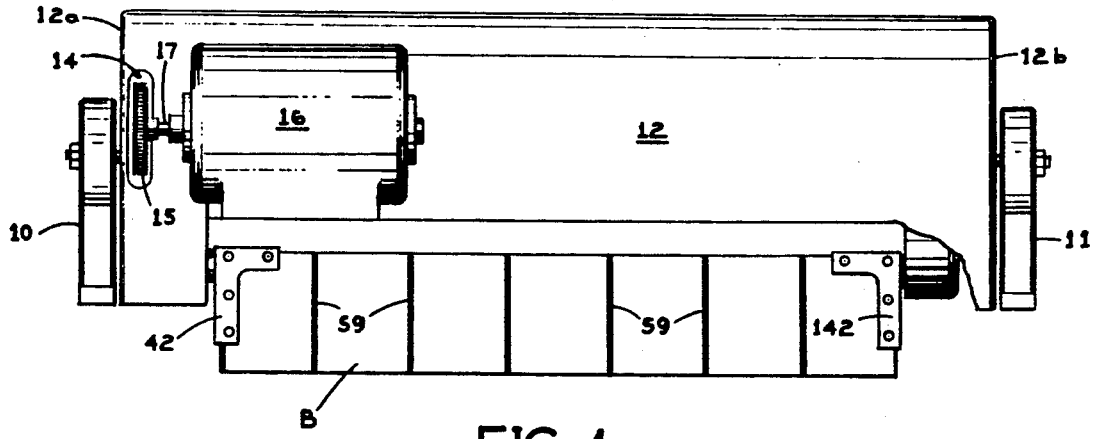
FIG. 1 is a front elevation of a paddlewheel apparatus in accordance with a first embodiment of the present invention.
Figure 3:
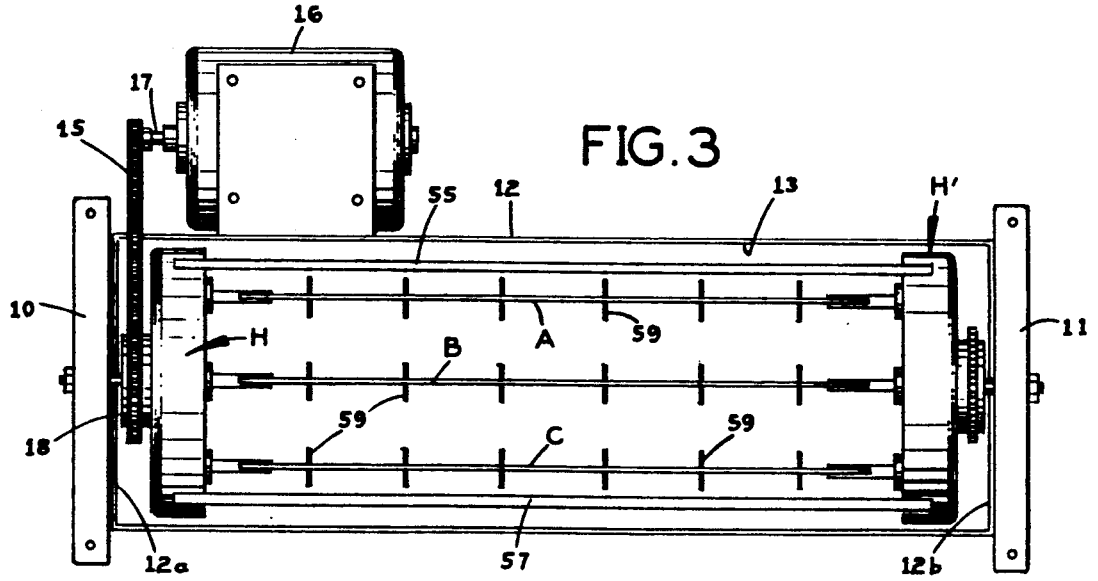
FIG. 3 is a bottom plan view of this apparatus.

Referring to FIG. 1, the present apparatus has fixedly mounted opposite end blocks 10 and 11 and a generally inverted U-shaped housing 12 extending between the end blocks. Housing 12 has flat opposite end walls 12*a* and 12*b* located a short distance in from the respective end blocks 10 and 11. Housing 12 provides a rectangular opening 13 (FIGS. 3 and 5) along the bottom. On the front (FIG. 1) housing 12 has an oblong opening 14 which passes a flexible endless drive chain 15 (FIG. 2) of conventional design. An electromotive force device 16, which may be either an electric motor or an electric generator, is mounted on the front of housing 12. EMF device 16 has a rotatable shaft 17 carrying a gear which engages the drive chain 15 at one end. Shaft 17 is the input shaft for the EMF device 16 if it is a generator and it is the output shaft if the EMF device is a motor.

Figures 4, 8:
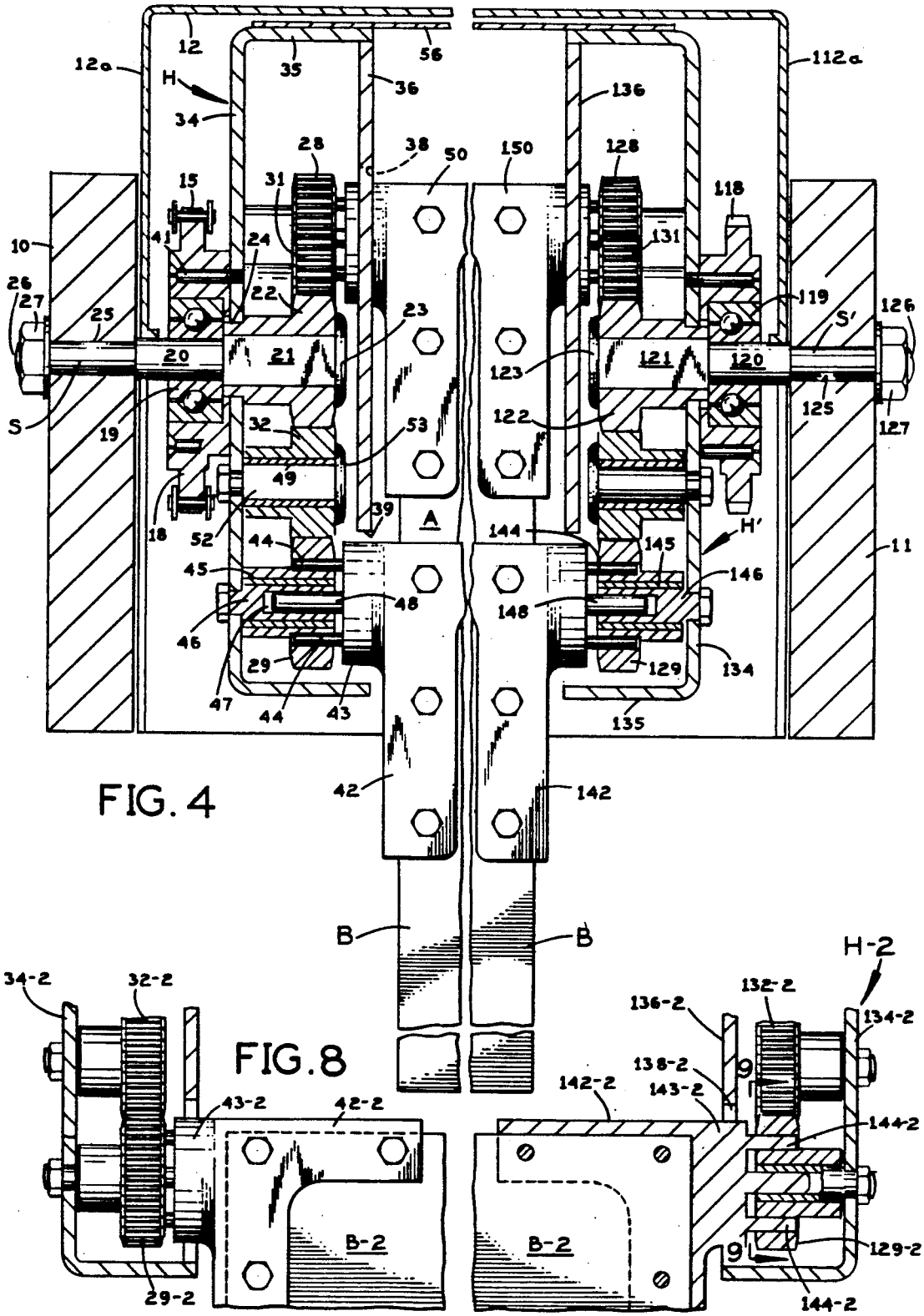
FIG. 4 is a vertical longitudinal section showing the opposite end portions of the apparatus along the line 4—4 in FIG. 2 at the central axis of the apparatus.
FIG. 8 is a view taken from the same position as FIG. 4 and showing a different arrangement for coupling each paddle to the corresponding planetary gear in the paddlewheel apparatus.

At its end away from the EMF device 16, chain 15 extends around and drivingly engages a gear 18 (FIGS. 2 and 4) located inside the housing 12 close to its end wall 12*a*. As shown in FIG. 4, gear 18 is mounted on a ball bearing 19 which encircles a cylindrical segment 20 of a fixed central shaft S. Therefore, gear 18 can rotate on shaft or hub S, and the axis of this shaft is the axis of rotation of gear 18, which is a drive member in this paddlewheel apparatus.

Laterally inward from bearing 19, shaft S has a segment 21 of rectangular cross-section on which a central sun gear 22 is snugly but slidably mounted. At its inner end shaft S has an annular peripheral flange 23 which engages the inner end face of gear 22. Gear 22 has a reduced cylindrical segment 24 at its laterally outward end which engages the inner end of the inner race of bearing 19. Shaft S extends snugly but slidably through an opening 25 in end block 10 and presents a screw threaded outer end segment 26 on which a flanged clamping nut 27 is threadably mounted. Nut 27 is tightened to hold the flange 23 on the inner end of shaft S tightly against gear 22, so that both shaft S and sun gear 22 are fixedly positioned and cannot rotate. Gear 22 is the fixed sun gear in an epicyclic gear train of known design.

Three planet gears 28, 29 and 30 (FIG. 6) are arranged at equal intervals circumferentially around sun gear 22 and are coupled to the sun gear by respective idler gears 31, 32 and 33. Each planet gear 28, 29 and 30 is the same diameter and has the same number of teeth as the sun gear 22. FIG. 4 shows in detail how idler gear 32 is engaged between sun gear 22 and planet gear 29, meshing with both of them.

Figure 5:
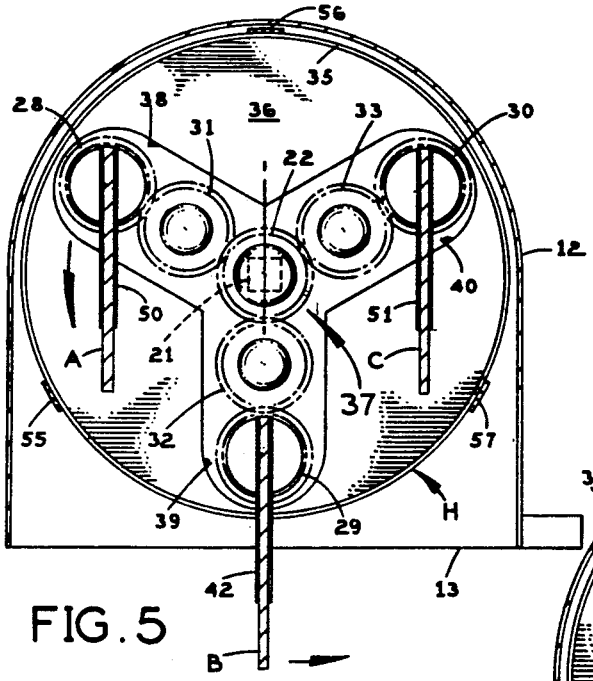
FIG. 5 is a vertical cross-section taken along the line 5—5 in FIG. 2.

The planet gears 28, 29 and 30 and the idler gears 31, 32 and 33 are rotatably mounted on a cylindrical holder H which has a generally Y-shaped opening in its inner end wall, as shown in FIG. 5. As shown in FIG. 4, holder H is of two-piece construction. The outer piece of the holder has a flat, generally circular outer end wall 34 and a cylindrical peripheral wall 35 joined integrally to this end wall and extending perpendicularly inward from it. The inner piece 36 of holder H is a flat plate attached rigidly to the inside of peripheral wall 35 and extending from it parallel to the outer end wall 34. The inner piece 36 of holder H has a generally Y-shaped opening 37 (FIG. 5), the legs of which extend at 120 degree intervals, as shown at 38, 39 and 40 in FIG. 5. These legs of the Y-shaped opening are aligned respectively with planet gears 28, 29 and 30. Bolts 41 (FIG. 4) attach the drive gear 18 to the outside of the outer end wall 34 of housing H. Therefore, housing H and gear 18 rotate in unison.

As shown in FIG. 4, a bracket 42 on the upper end of a paddle B has a cylindrical projection 43 which is loosely received in leg 39 of the Y-shaped opening 37 in the inner piece 36 of the holder H. A plurality of pins 44 extend from bracket projection 43 into complementary openings in planet gear 29. Gear 29 is on a cylindrical anti-friction bushing 45 on a stem 46 that is clamped to the holder end wall 34. Stem 46 has a cylindrical socket 47 which snugly but slidably receives a centering pin 48 on bracket projection 43. The axis of planet gear 29 coincides with the axis of stem 46. With this arrangement, planet gear 29 can rotate with respect to stem 46 and bracket 42 moves in unison with gear 29.

FIGS. 4 and 5 show bracket 42 extending down through the bottom opening 13 in housing 12 and paddle B extending down from bracket 42.

A bracket 50 (FIG. 5) that is identical to bracket 42 is coupled in the same manner to planet gear 28, and a paddle A extends down from bracket 50.

Similarly, an identical bracket 51 (FIG. 5) is coupled in the same manner to planet gear 30 and a paddle C extends down from bracket 51.

The idler gear 32 that meshes with the stationary sun gear 22 and planet gear 29 in the epicyclic gear train is on a cylindrical anti-friction bushing 49 (FIG. 4). Bushing 49 is on a shaft or hub 52 that is clamped to the outer end wall 34 of holder H. A transverse flange 53 on the inner end of shaft 52 engages the inner end of bushing 49 and the inner end of gear 32. With this arrangement, gear 32 can rotate on shaft 52 as holder H turns.

Each of the other intermediate gears 31 and 33 is rotatably mounted on the holder in the same manner as gear 32.

As shown in FIG. 1, paddle B extends lengthwise from bracket 42 a short distance in from end block 10 to a similar bracket 142 a short distance in from the opposite end block 11. Bracket 142 is a mirror image of bracket 42. As shown in FIG. 4, bracket 142 is coupled to planet gear 129 in the same manner as already described in detail for bracket 42 and gear 29. Elements at the right end which correspond to the elements at the left end have the same reference numerals plus 100 and need not be described in detail. The rotatable holder at the right end is designated in its entirety as H' and the stationary shaft or hub there is designated as S'.

Between the holders H and H' each paddle A, B and C has a plurality of stiffening ribs 59 (FIG. 2) at intervals along its length. Each of these stiffening ribs extends perpendicular to the opposite major faces of the paddle and projects on opposite sides of the paddle.

An important feature of this invention is that there is no obstruction, such as an axle, below any of the three paddles A, B and C at any instant during each rotation of holders H and H'. For this reason each paddle may have a vertical dimension below the axis of its gear 28, 29 or 30 greater than the radial distance between the axis of the fixed central gear 22 and the axis of the planet gear to which that paddle is connected. The greater this vertical dimension of the paddle, the farther the paddle can enter the water in its lowermost position (as shown for paddle B in FIG. 5) and therefore the greater the power transfer from paddle to water or vice versa.

The holders H and H' at the opposite ends of the apparatus are connected by three longitudinal rigid straps 55, 56 and 57 removably attached to each of them at 120 degree intervals circumferentially. These straps insure that the two holders rotate in unison. Each of these straps is midway between a corresponding pair of the planet gears 28, 29 and 30 so as not to obstruct the paddles A, B and C hanging down.

If desired the chain 15 may engage gear 118 at the right end instead of gear 18 at the left end. The EMF device will be located at the same end of the apparatus as the chain.

OPERATION

In the operation of the paddlewheel apparatus, as described, if EMF device 16 is a motor, it will rotate gear 18 through chain 15. Holder H rotates in unison with gear 18 and causes the planet gears 28, 29 and 30 to revolve circumferentially around the sun gear 22 (which does not rotate with gear 18 and holder H). Through the gear-toothed coupling between planet gears 28, 29 and 30 and sun gear 22 that is provided by idler gears 31, 32 and 33, the planet gears turn within the rotating holder H such that they always maintain the respective paddles A, B and C hanging down vertically. Holder H' at the opposite end rotates in unison with holder H, and the planet gears in the epicyclic gear train in holder H' also keep the paddles hanging down vertically.

Figure 7:
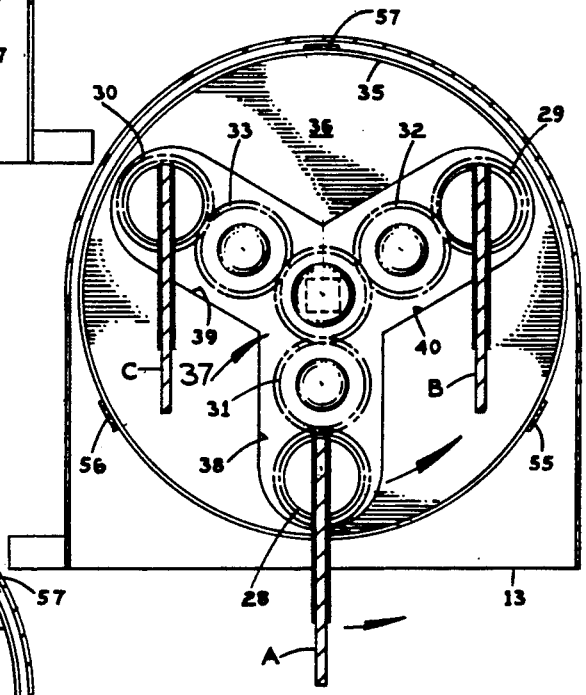
FIGS. 6 and 7 are views like FIG. 5 and showing the paddles in different positions around the central axis of the paddlewheel apparatus.
Figure 6:
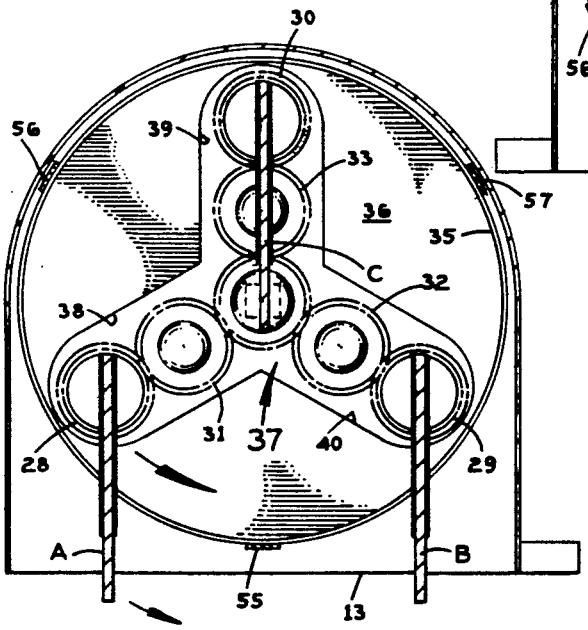

FIGS. 5, 6 and 7 show the positions of the parts at 60 degree intervals of counterclockwise rotation of holder H.

In FIG. 5 paddle B is in its lowermost position, hanging down through the bottom opening 13 in housing 12 vertically below the axis of shaft S (which is the rotational axis of holder H), and paddles A and C are on opposite sides of paddle B.

FIG. 6 shows the paddles 60 degrees counterclockwise from their positions in FIG. 5. Now paddles A and B extend down through the bottom opening 13 in housing 12 on opposite sides of the rotational axis of holder H, and paddle C hangs down vertically in its uppermost position.

FIG. 7 shows the paddles 60 degrees counterclockwise from their FIG. 6 positions. Now paddle A hangs down through the bottom opening 13 in housing 12, and paddles C and B are on opposite sides of paddle A.

Essentially the same action takes place in reverse if the EMF device is a generator and the motive power for the paddlewheel apparatus is from a fluid stream, such as water. For example, the paddlewheel may be on a boat moving through the water, in which case the relative movement between the water and the paddles causes the holder H to rotate.

Second Preferred Embodiment

Figure 9:
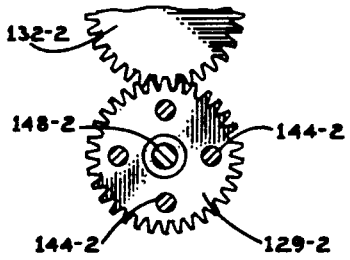
FIG. 9 is a fragmentary cross-section taken along the line 9—9 in FIG. 8 and showing one of the planet gears meshing with a corresponding idler gear.

FIGS. 8 and 9 show a second embodiment having a slightly different coupling between each planet gear and the corresponding paddle. Corresponding elements in these Figures have the same reference numerals as those in FIGS. 1–7 with a "-2" suffix added. It is unnecessary to repeat the detailed description of these corresponding elements.

On the right side in FIG. 8 the bracket 142-2 attached to the upper end of paddle B-2 has a laterally outwardly protruding head 143-2 extending through an opening 138-2 in the inner end wall 136-2 of a holder H-2 like Holder H in FIGS. 1–7. Solid cylindrical projections 144-2 extend from bracket head 143-2 into off-center openings in the corresponding planet gear 129-2.

Third Preferred Embodiment

A third embodiment of the invention is shown in FIGS. 10–15. Elements of this third embodiment which correspond to the elements of the first embodiment are given the same reference numerals with a "-3" suffix added. The detailed description of these corresponding elements will not be repeated.

This third embodiment has four paddles A, B, C and D at 90 degree intervals circumferentially around the longitudinal axis of the apparatus. At the left end in FIG. 11, paddle D is attached to a planet gear 60. An idler gear 61 is engaged between planet gear 60 and the central gear 22-3. At the right end of the apparatus, paddle D is attached to a planet gear 160 which is coupled to central gear 122-3 through an idler gear 161. Each paddle is symmetrical with respect to the rotational axis of the corresponding planet gear at each end, extending the same distance above and below that axis.

At the right end in FIG. 11, a gear 118-3 is bolted to a horizontal shaft S'-3, the inner end of which is joined to the inner end wall 136-3 of holder H'-3 for the epicyclic gear train at this end of the apparatus. Shaft S'-3 is rotatably supported by anti-friction bearings 162 and 163 on opposite sides of gear 118-3. Gear 118-3 is the input gear if the paddlewheel apparatus is driven from a motor, and it is the output gear if the paddlewheel apparatus is driven by the water engaged by its paddles. Central gear 122-3 is bolted to a hub 164 on the upper end of the end block 11-3 at this end of the apparatus. This end block also supports bearings 162–163.

With this arrangement, rotation of the gear 118-3 (acting as an input drive gear) causes shaft S'-3 and holder H'-3 to rotate in unison with it. The planet gears (e.g., 160 and 129-3) in holder H'-3 revolve about the axis of shaft S'-3 as holder H'-3 rotates.

Holder H'-3, in addition to its inner end wall 136-3, has a cylindrical peripheral wall 135-3 joined integrally to end wall 136-3 and a flat outer end wall 134-3 attached to peripheral wall 135-3. The outer end wall 134-3 of holder H'-3 has a circular central opening 165 which passes the hub 164 on end block 11-3 with a large clearance. A flat annular plate 166 on the outside of outer end wall 134-3 has a central opening which encircles hub 164 snugly but without interfering with the rotation of holder H'-3 on the hub. An annular fitting 167 on the inside of outer end wall 134-3 supports a fluid seal 168 which engages the hub 164 in water-tight fashion.

Each of the idler gears 131-3, 132-3, 133-3 and 161 at the right end of the paddlewheel apparatus is rotatably mounted in holder H'-3 in the manner shown in detail in FIG. 12 for idler gear 132-3. Holder H'-3 has an off-center hub 169 projection from its inner end wall 136-3 toward its outer end wall 134-3. Hub 169 has an annular recess 170 which receives a needle bearing 171 that rotatably supports a flanged shaft member 172 to which the idler gear 132-3 is bolted.

Each of the planet gears 128-3, 129-3, 130-3 and 160 at the right end of the apparatus is coupled to the corresponding paddle A, B, C or D in the manner shown in detail in FIG. 12 for planet gear 129-3 and paddle B. Holder H'-3 has an off-center segment 173 projecting from its inner end wall 136-3 toward its outer end wall 134-3. Segment 173 has an annular recess 174 which receives a needle bearing 175 that rotatably supports a flange bushing 176 to which planet gear 129-3 is bolted. As shown in FIGS. 12 and 14, bushing 176 has a radially projecting annular flange 177 which is engaged by the inside face of the planet gear 129-3 and is rigidly attached to this planet gear by bolts 178.

A horizontal shaft 179 is rigidly attached to paddle B by a bolted-on bracket 180 and extends outward from the paddle longitudinally of the paddlewheel apparatus. Shaft 179 passes through the inner end wall 136-3 and segment 173 of holder H'-3 and it is rotatably supported by the flange bushing 176. A seal 181 engages shaft 179 in water-tight fashion at a recess 182 in holder H'-3 and inward beyond the inner end wall 136-3 of this holder. An annular retainer 183 for seal 181 is screw-threadedly received in holder H'-3 and holds the seal compressed against shaft 179 sufficiently to provide a water-tight seal around the shaft.

At its end away from paddle B, shaft 179 has a cutaway segment with a central core 184 of reduced cross-section and diametrically-opposed radial ribs 185 and 186 extending out from this core. Planet gear 129-3 has a central opening 187 (FIG. 14) in which a pair of arcuate segments 188 and 189 are press-fitted diametrically opposite one another. Arcuate segments 188 and 189 rotatably receive the reduced core of 184 of shaft 179 and between them they define arcuate slots 190 and 191 (FIG. 13) which receive the outwardly projecting ribs 185 and 186 of the shaft. These arcuate slots are of substantially greater extent circumferentially of shaft 179 than the ribs 185 and 186 so as to provide a lost-motion coupling between paddle B and planet gear 129-3 when the paddle first encounters resistance. For example, in the case of a motor-driven paddlewheel apparatus, when the paddle B first enters the water this lost-motion coupling permits limited relative rotation between planet gear 129-3 and paddle B.

An identical lost-motion coupling is provided between each of the other paddles A, C and D and the corresponding planet gear 128-3, 130-3 and 160 at the right end of the paddlewheel apparatus.

At the left end of the apparatus in FIG. 11, there is an identical arrangement, the parts of which have the same reference numerals, minus 100, as the parts at the right and except that the central shaft is designated S-3 and the holder for the epicyclic gear train is designated H-3.

As shown in FIG. 10, the sun gear 22-3 at the left end of the paddle wheel apparatus is of two-piece construction, composed of similar halves on opposite sides of shaft S-3. This is also true of the sun gears 122-3 at the right end. This two-piece construction of each sun gear makes it easier to assemble on the corresponding shaft S-3 and S'3 and to replace, when necessary. The holders at the opposite ends are connected by rigid straps 55-2, 56-2, 57-2 and 58-2 as in the other embodiment.

As shown in FIG. 15, each holder has access openings 200, covered by covers 202, which are removable to allow access within the holders and say for maintenance purposes. These holder covers also serve to limit the distance of the outward thrust of gear shafts 172 and 184 thereby maintaining proper position of said shafts within their respective bearing enclosure.

Fourth Preferred Embodiment

The fourth preferred embodiment is like the first three except that the paddles are freed to pivot in the direction of the fluid flow relative to the apparatus to prevent drag. For purposes of illustration, it is assumed that the apparatus propels a ship. In place of the EMF device 16, a steam or internal combustion engine may power the apparatus.

Since paddles A, B, and C move about the circumference of a circle, their direction of movement, or velocity, continuously changes. At the instant the axis of the planet gears supporting a given paddle is horizontal with the axis of the sun gears 22 and 122, the direction of the given paddle's velocity is vertical, either straight up or straight down. If moving straight down toward the water, the velocity of the paddle gradually develops a horizontal component in the direction of water flow relative to the apparatus. At the same time, the vertical component gradually diminishes. When the paddle is directly below the axis of the sun gears, the paddle velocity is entirely horizontal.

The changing horizontal component of paddle velocity creates a problem of drag over a portion of the rotational path. When the paddle initially touches the water surface, the horizontal component of paddle velocity is less than the horizontal component of the water velocity relative to the apparatus. Thus, since the water at this point is moving faster than the paddle, it drags against the paddle. As the paddle advances along its path, the horizontal component of the paddle velocity overtakes and surpasses the relative horizontal water velocity, and the engine drives the paddle against the water, propelling the ship. Then, as the paddle begins to rotate upward, the horizontal component of the paddle velocity diminishes. Before the paddle can rise out of the water, the horizontal velocity of the water overtakes that of the paddle, again causing drag.

A way to virtually eliminate drag is to free the paddles to pivot in the direction of water flow. When the water moves faster than the paddle, the paddle can swing to a more nearly horizontal position. The action of a given paddle during immersion depends on its location along its path. As the paddle enters the water, it pivots to ride at an angle. As its horizontal velocity component becomes greater than that of the water, the force of the paddle against the water orients the paddle vertically to present its broad surface area. As the paddle starts to rise, and slows horizontally to less than the water velocity, the water pivots the paddle to ride at an angle. As the paddle leaves the water, it is reoriented vertically by gravity.

Several minor changes to the apparatus permit the unidirectional pivoting. All pins equivalent to pins 44 and 144 are eliminated so that the paddles are freed to pivot. For this embodiment shaft S has a circular cylindrical cross-section only and the sun gears 22 and 122 are freed to rotate on shafts about their axes. Each centering pin, such as pin 48, is altered to be of the same diameter as each stem, such as stem 36. Each pin extends through the axial hole in a given planet gear up to a flange 177 (FIGS. 12 and 14) that attaches to the planet gear. A split or gap 302 is provided in the bushing between each planet gear and the centering pin. Gap 302 is preferably a one quarter radial section, equivalent to ninety degrees of the circumference. See FIGS. 16 and 17. The bushing is rotatably mounted on the stem and centering pin, while the planet gear is affixed to the bushing. The centering pin contains a diametric slot or key way 304 into which a key 306 is fitted. The key 306 extends from the surface of the centering pin into the gap 302 in the bushing. The paddle is free to pivot in a given direction about the centering pin until the bushing ends 310 and 312 abut against the key 306. The abutment of key 306 against bushing end 310 stops further rotation in a given direction. Then the paddle can pivot in the opposite direction until the key 306 abuts the other bushing end 312.

Since the gap 302 represents one circumferential quarter of the bushing, the full paddle pivot is ninety degrees. The key 306 and gap 302 are positioned so that the paddle is vertical at one extreme of its free pivot range and horizontal at the other. This permits the paddle to remain fixed against rotation in one direction to drive against the water and to pivot up in the other direction when the horizontal velocity of the water overtakes that of the paddle. Thus the full drive portion of the stroke is retained while the drag portion is virtually eliminated An important added benefit of the free pivoting is that the ship can coast with the engine stopped and the paddles will not drag, for the reasons set forth above.

The free pivot direction must be reversed if the engine and apparatus are to drive the ship in reverse. For this purpose, a lever 320 is attached to the sun gear 22. See FIGS. 18, 19, 20 and 21. Lever 320 is rotatable over a range of ninety degrees between two fixed stops 322 and 324 which are attached fixedly to end block 11 (FIG. 21). A ninety degree rotation of the sun gear 22 rotates each planet gear by ninety degrees, reorienting the gap 302 in the bushing by ninety degrees. The new position of the gap 302 permits each paddle to pivot from a vertically downward position to a horizontal position opposite its original pivot direction. The paddles are thereby fixed against rotation in the direction opposite the reversed water flow and so can drive the ship in the reverse direction. The paddles are free to pivot in the reversed direction of water flow to prevent drag.

The apparatus can also serve as a braking device to help stop the ship. A brace or powered arm or drive means 340 may be attached to the lever 320 to rotate the sun gear 22 to hinder the paddle movement. See FIG. 22. In this instance, drag is desired and the hindered paddles provide the drag. When the vessel is a small boat, the lever may be pulled by hand to create the braking action.

If a full set of gears is provided in both right and left holders, the lever 320 has to be attached to each of the sun gears in each holder and both sun gears should be rotatable by the lever.

At the right and left opposite end walls **12*b* and 12*a* of housing 12 are openings (not shown) which provide access into the interior of housing 12** for maintenance purposes. These openings each have a removable cover.

It is understood that the fourth embodiment is contemplated to find application other than on boats and ships. For example, the same apparatus with the free pivot feature may serve as a turbine in a hydro-electric dam.

I claim:

1. A paddlewheel apparatus comprising:

first and second fixed supports spaced apart along a predetermined axis;

first and second sun gears respectively supported from said first and second supports on said axis;

first and second holders rotatable on said axis and extending around said first and second sun gears respectively, said holders being interconnected to rotate in unison;

a drive member drivably connected to said first holder on the outside and rotatable in unison with said first holder;

a first set of additional gears forming a first epicyclic gear train with said first sun gear and rotatably mounted within said first holder, said first set of additional gears including planet gears spaced apart circumferentially around said first sun gear;

a second set of additional gears forming a second epicyclic gear train with said second sun gear and rotatably mounted within said second holder, said second set of additional gears including second planet gears spaced apart circumferentially around said second sun gears;

and a plurality of paddles located between said holders and each coupled at its opposite ends to a corresponding planet gear of said first epicyclic gear train and to a corresponding planet gear of said second epicyclic gear train, each of said paddles hanging down substantially vertically and being unobstructed between said holders in all rotational positions of said holder;

a lost-motion coupling between each of said paddles and said corresponding planet gears at its opposite ends, said lost-motion coupling permitting rotational lost-motion between each said paddle and its corresponding planet gears;

and wherein at least one said sun gear is free to rotate on said axis, additionally comprising lever means attached to at least one said sun gear for rotating said sun gear about its axis to alter the positions of the planet gears.

2. A paddlewheel apparatus according to claim 1 additionally comprising powered drive means for rotating said lever means.

3. A paddlewheel apparatus according to claim 1, wherein each planet gear has an axial bore with a cylindrical wall and each paddle connected to a given planet gear has axle means with two ends, one of the two ends extending into said bore and having key means, and each planet gear having an internal bushing with a radial indentation, with two radial walls, into which the key means extends, such that the axle means and paddle are free to rotate within the given planet gear over the range permitted by the radial indentation until the key means abuts either radial wall.

4. Paddlewheel apparatus according to claim 1 wherein each of said epicyclic gear trains includes a plurality of idler gears, each in toothed engagement with the corresponding sun gear and a corresponding planet gear.

* * * * *